US006213702B1

(12) United States Patent
Wesselink

(10) Patent No.: US 6,213,702 B1
(45) Date of Patent: Apr. 10, 2001

(54) METHOD FOR MANUFACTURING A BOOKLET, BOOKLET MANUFACTURED ACCORDING TO THE METHOD AND BOOKLET

(75) Inventor: Wilhelmus Johannes Wesselink, Haarlem (NL)

(73) Assignee: Enschede SdU B.V., Haarlem (NL)

( * ) Notice: Subject to any disclaimer, the term of this patent is extended or adjusted under 35 U.S.C. 154(b) by 0 days.

(21) Appl. No.: 09/464,505

(22) Filed: Dec. 15, 1999

(30) Foreign Application Priority Data

Dec. 18, 1998 (NL) ..... 1010841

(51) Int. Cl.[7] ..... B42C 11/00; B42D 1/00

(52) U.S. Cl. ..... 412/1; 412/6; 412/4; 412/8; 281/23; 281/28; 281/29; 281/21.1

(58) Field of Search ..... 412/1, 2, 4, 6, 412/17, 19, 21, 30; 281/29, 21.1, 28, 4, 5, 6, 7, 8, 9, 12

(56) References Cited

U.S. PATENT DOCUMENTS

| | | | | |
|---|---|---|---|---|
| 347,718 | * | 8/1886 | Kempshall . | |
| 596,607 | * | 1/1898 | Muhlhauser . | |
| 931,679 | * | 8/1909 | Chivers . | |
| 1,366,990 | * | 2/1921 | Williams . | |
| 2,314,087 | * | 3/1943 | Heller . | |
| 2,349,947 | * | 5/1944 | Einzig . | |
| 4,492,306 | * | 1/1985 | Cooper et al. | 206/216 |
| 4,525,116 | * | 6/1985 | Holmberg | 412/8 |
| 4,723,861 | * | 2/1988 | Merchant | 402/8 |
| 4,741,655 | * | 5/1988 | James | 412/6 |
| 4,789,418 | * | 12/1988 | Corlew et al. | 281/15 |
| 4,793,758 | * | 12/1988 | Hanson et al. | 412/4 |
| 5,035,447 | * | 7/1991 | Lolli | 281/15 |
| 5,098,127 | * | 3/1992 | Williamson et al. | 281/15.1 |
| 5,207,456 | * | 5/1993 | Danhoff | 281/40 |
| 5,248,164 | * | 9/1993 | Lepretre | 281/22 |
| 5,566,979 | * | 10/1996 | Ong | 281/21.1 |
| 5,590,912 | * | 1/1997 | Stevens | 283/56 |
| 5,674,021 | * | 10/1997 | Hutnick | 402/14 |
| 5,725,196 | * | 3/1998 | Scheel | 281/21.1 |
| 5,967,555 | * | 10/1999 | Samelian | 281/21.1 |

* cited by examiner

*Primary Examiner*—A. L. Wellington
*Assistant Examiner*—Alisa L. Thurston
(74) *Attorney, Agent, or Firm*—Thomas, Kayden, Horstemeyer & Risley

(57) ABSTRACT

Method for manufacturing a booklet, such as for instance an ID, which booklet is provided with a number of sheets of paper and a cover material, each sheet having a front and a reverse side, each side comprising two pages, which method comprises connecting the sheets of paper to each other along a line between the pages, attaching the cover material to the outside of the booklet, and making a fold in the sheets of paper to form a back of the booklet, and bringing the booklet to the correct size, characterized in that the method further comprises attaching a band, which can be attached in the booklet in the same manner as in which the paper sheets are attached to each other, and mechanically attaching a plate to the band, the plate being at least partially made of synthetic material, and having a front and a reverse side, each side comprising one page. Booklet, manufactured according to a method according to the invention.

12 Claims, 3 Drawing Sheets

Figure 1:
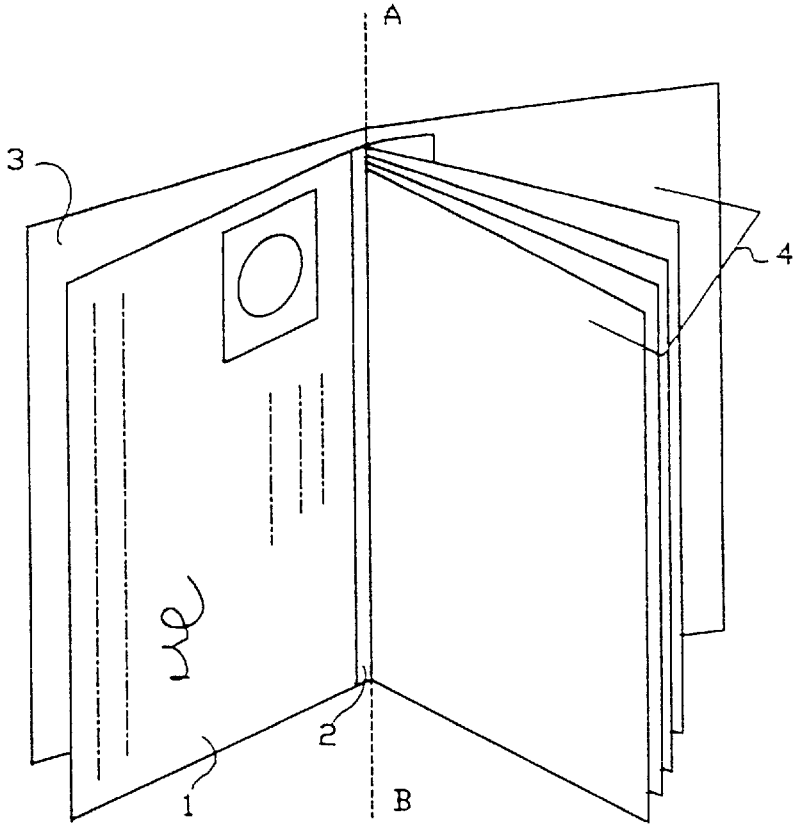

METHOD FOR MANUFACTURING A BOOKLET, BOOKLET MANUFACTURED ACCORDING TO THE METHOD AND BOOKLET

The invention relates to a method for manufacturing a booklet, such as for instance an ID, which booklet is provided with a number of sheets of paper and a cover material, each sheet having a front and a reverse side, each side comprising two pages, which method comprises connecting the sheets of paper to each other along a line between the pages, attaching the cover material to an outside of the booklet, and making a fold in the sheets of paper to form a back of the booklet. The invention particularly relates to a method for permanently attaching a rigid plate-shaped material or assembly of materials (laminate), at least partially consisting of synthetic material, in a booklet.

When manufacturing passports or other ID's in the shape of a book, booklets for recording medical data and the like, in some cases a relatively rigid plate-shaped material or laminate is permanently attached in the booklet. A usual method for the manufacturing of these booklets is that the sheets of paper, which are printed on both sides such that each side comprises two pages, are laid onto each other in the correct order and the correct number for the construction of the booklet, and that the sheets are connected to each other by for instance sewing with a yarn, or stapling along a line between the pages. After connecting, a cover material is attached to the outside of the booklet, for instance by gluing, and a fold is made to form the back of the booklet. When necessary the booklet is brought to size by cutting off along the edges that are not folded. In a known type of ID it is usual to use one page for stating the data of the holder (such as name, address, date of birth, a registration number, signature and passport photo) and data about the document itself (such as the issuing authority, document number, date of issue, period of validity). Such a so-called holder page has to meet a number of requirements. The data have to be arranged permanently, so that they are not damaged by influences of use. In order to prevent illegal use by forgery, it should be impossible to simply change the data. As a result of the developments in the information technology it is an advantage when the data can be read automatically. To that end, with for instance passports, international agreements are made about the nature of the data to be stated and the place where these data are placed. The holder page is attached to a page in the booklet, or to the inside of the cover.

In order to comply with the wish to further increase the security against forgery, and to be able make use of the latest developments in the field of data storage and data communication, it was attempted to also make use of the developments in the field of identity cards in documents in the shape of a book. These identity cards, which are at least partially made of synthetic material, for data storage can also be provided with a magnetic strip, an integrated electronic microcircuit (IC or chip), which has been provided with contacts or an antenna, a layer for optical data storage, a bar or point code or combinations of these media. Both for reading out these storage media, and for the protection against influences of use (bending, folding) it is necessary that they are used on or in a material which is considerably more smooth, more rigid and (in case of IC's) thicker than the paper pages in the passport. In addition the cards made of a synthetic material can be provided with visually readable texts and images, which in this way are better protected against forgery than when arranging on paper. It would therefore be an advantage when such a card made of a synthetic material could be attached in a booklet. However, the cards cannot be attached to the paper pages of the passport, in the manner in which the paper pages are attached to each other, because they cannot be sewn, stapled and folded. A known solution is to make the cards thinner in the area where sewing and folding takes place. As a result of the smaller thickness the material can be bent more. However, this is not a good solution because the sewing, stapling and folding may result in such a weakening that tearing or breaking may occur too soon. Because the synthetic material still is considerably more rigid than paper a further disadvantage is that the booklet cannot be closed.

It is an object of the present invention to provide a method for manufacturing a booklet, such as for instance an ID, to overcome the disadvantages of the known state of the art.

To that end according to the present invention a method of the above-mentioned kind is characterized in that the method further comprises attaching a band in the booklet, which can be attached in the booklet in the same manner as in which the paper sheets are attached to each other, and mechanically attaching a plate to the band, the plate being at least partially made of synthetic material, and having a front and a reverse side, each side comprising one page. According to the inventive method the plate is attached to a band of a material which is indeed suitable to be sewn along in the booklet or to be stapled to it, and which can be folded many times without breaking or tearing taking place. The assembly of the plate and the band is inserted in a stack of pages to be sewn, and after sewing the plate is attached in the booklet. Instead of inserting the assembly of the plate and band, just the band can be inserted, and be attached in the booklet by means of sewing. Then the plate is also attached in the booklet. The connection between plate and band is of a mechanical nature allowing an almost complete freedom of choice in material of both parts. This is different with a connection which is of a physical and/or chemical nature, such as a glue connection or a connection by fusing together. In the latter cases the materials at least have to be adapted to each other in order to be able to connect them. The freedom of choice in material is important, because some of the desired properties of the plate and the band are conflicting.

A preferred embodiment of a method according is characterized in that the mechanical attachment is accomplished by clamping/enclosing, by providing the band with perforations, providing a synthetic strip and providing the synthetic strip with local projections, in which the synthetic strip is placed on the one side of the band, and the plate on the other side, and in which the local projections of the strip are chemically or physically connected to the plate. Alternatively the mechanical attachment is accomplished by providing the band with perforations, providing a synthetic strip, and providing the plate with local projections, in which the synthetic strip is placed on one side of the band, and the plate on the other side, and in which the local projections of the plate are chemically or physically connected to the strip.

Although the band and the plate are mechanically attached to each other, it is preferred that the material of which the plate is made and the material of which the strip is made, contain the same raw material, and that the connection between them is accomplished by fusing them together. Alternatively the connection between the plate and the strip is accomplished by gluing them together. Said connection technique allows using materials for the plate and strip, which are made of different raw materials.

A further preferred embodiment of a method according to the invention is characterized in that mechanically attaching is accomplished by clamping/enclosing, by providing the band with perforations, providing a synthetic strip and applying local quantities of glue on the strip, the synthetic strip being placed on the one side of the band and the plate being placed on the other side and the glue at least partially filling the perforations in the band and the glue in the perforations connecting the plate and the synthetic strip. Alternatively mechanically attaching is accomplished by providing the band with perforations, providing a synthetic strip and applying local quantities of a glue on the plate, the synthetic strip being placed on the one side of the band and the plate being placed on the other side and the glue at least partially filling the perforations in the band and the glue in the perforations connecting the plate and the synthetic strip.

The invention further relates to a booklet, such as an ID, made according to the method according to the invention.

Furthermore the invention relates to a booklet, such as an ID, which booklet is provided with a number of sheets of paper and a cover material, each sheet having a front and a reverse side, and each side comprising two pages, the sheets of paper being connected to each other along a line between the pages, the cover material being attached to an outside of the booklet, a fold being made in the sheets of paper to form a back of the booklet, characterized in that the booklet is further provided with a band, which is attached in the booklet in the same manner as in which the paper sheets are attached to each other, and with a plate, the plate being mechanically attached to the band, the plate being at least partially made of synthetic material, and having a front and a reverse side, each side comprising one page.

Figure 2:
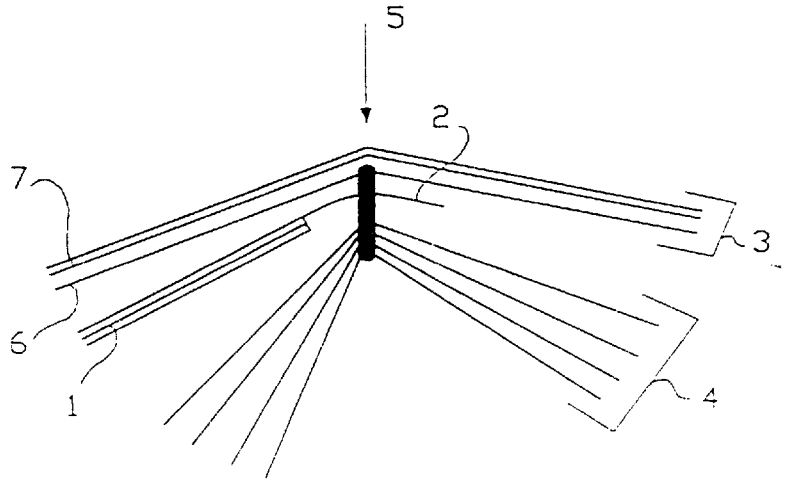
Figure 3A:
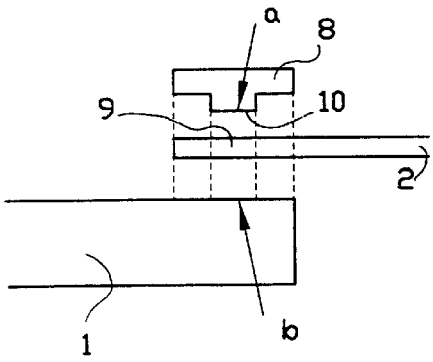
Figure 3B:
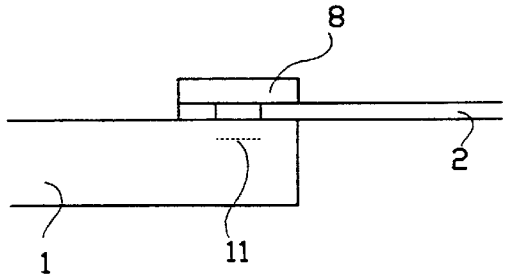
Figure 4A:
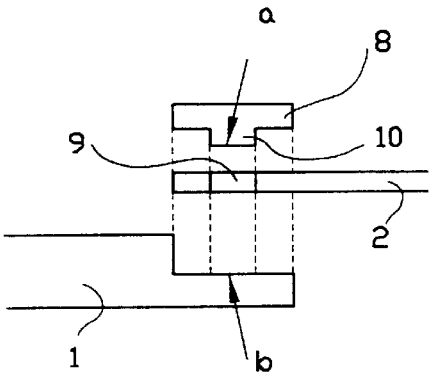
Figure 4B:
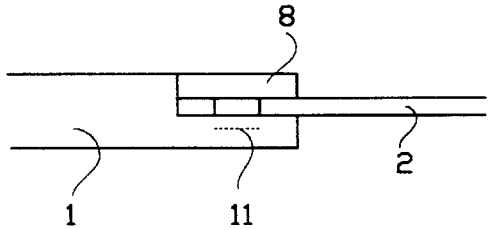
Figure 7A:
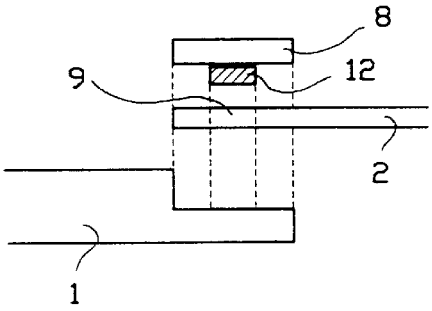
Figure 7B:
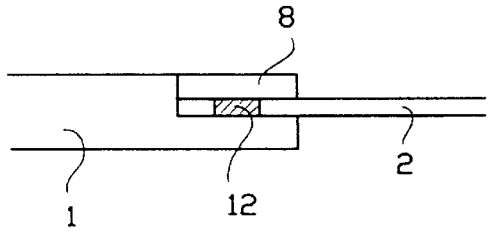
Figure 5:
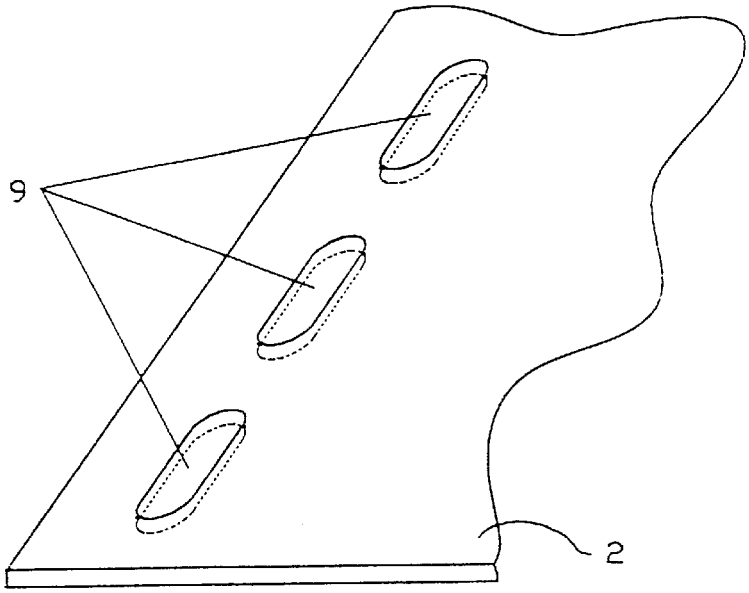
Figure 6:
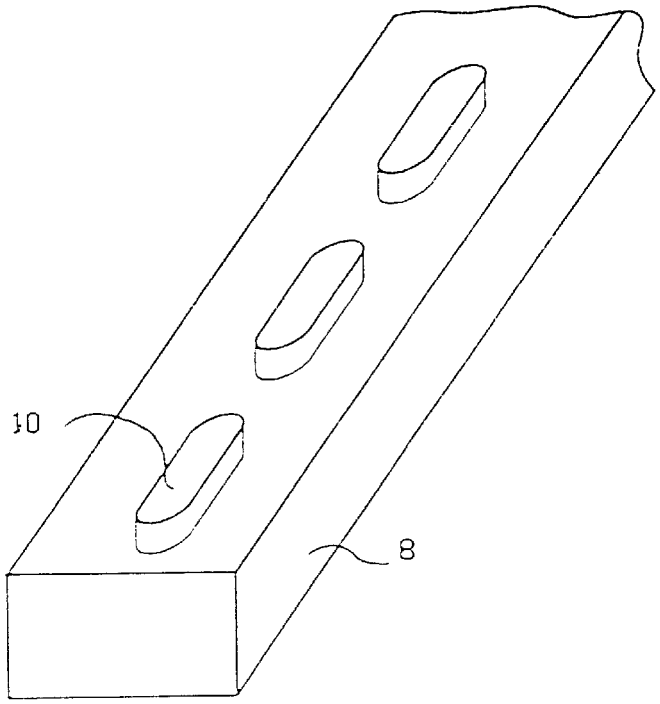

On the basis of an example and the accompanying drawings a description of a method and a booklet according to the invention are give, in which:

FIG. 1 shows a booklet, for instance a passport, according to the invention in open position, FIG. 2 shows a cross-section perpendicular to the line AB along which the booklet is bound, FIG. 3 shows the making of the connection between a plate of synthetic material and a strip of synthetic material, in which FIG. 3*a* shows the situation before connecting and FIG. 3*b* shows the situation after the connection has been made, FIG. 4 shows another embodiment of a method according to the invention, in which FIG. 4*a* shows the situation before connecting and FIG. 4*b* shows the situation after the connection had been made, FIGS. 5 and 6 are enlarged partial drawings of the band and the strip having the perforations and the local projections, respectively, and FIG. 7 shows yet another embodiment of the method according to the invention, in which FIG. 7*a* shows the situation before connecting and FIG. 7*b* shows the situation after the connection has been made.

In FIG. 1 a booklet, in the present case a passport, manufactured according to the method according to the present invention is shown. The booklet comprises a plate 1, for instance made of a synthetic laminate, preferably of polycarbonate films, on which a holder page is arranged. The holder page is provided with texts, a passport photo and a signature, preferably by means of writing with a laser. The combination of the raw material and the method for writing results in a good protection against forgery. The booklet further comprises band 2, for instance made of a synthetic material, which is suitable to be sewn and which is resistant against frequent bending; preferably made of polypropylene. The strip 2 is attached to the laminate 1, and by means of sewing along the line AB connected to the other pages 4 of the booklet. Furthermore the booklet is provided with a cover 3.

The thickness of the synthetic laminate 1, preferably is between approximately 0.25 mm and approximately 0.90 mm and in particular 0.76±0.08 mm. The thickness of the synthetic band is between approximately 0.10 mm and approximately 0.40 mm. Other possible raw materials of the synthetic laminate 1 are polyvinyl chloride, acrylonitrile butadiene styrene, polyethene terephtalate and copolyester PETG. For the band 2 in addition to polypropylene all materials can be used which meet the wanted properties of strength and flexibility; in addition to synthetic materials among others woven structures or non-wovens can be used.

In FIG. 2, 5 indicates the position where an inside page 6 of the cover, the synthetic band 2 and the other pages 4 of the passport are connected to each other by yarn. The outside of the cover is formed by book binding material and is connected to the inside page 6 by for instance glue.

According to the invention the mechanical connection is accomplished by means of a strip 8 (FIGS. 3*a* and 3*b*), which is provided with local projections 10. Said projections 10 fit into the perforations 9 which are provided in the synthetic band 2. The projections 10 and the perforations 9 preferably are circular or oval (see FIGS. 5 and 6). The height of the projections 10 is equal to the thickness of the synthetic band 2. The surfaces a and b (FIGS. 3 and 4) are the locations where a connection is accomplished between the strip 8 and the laminate 1 by means of gluing together or fusing together. In FIG. 3*b* the location where the connection has been accomplished is shown by the dotted line 11.

FIG. 4 shows another embodiment of the method and the booklet according to the invention, in which a portion, at a thickness of the band 2 and the strip 8, has been milled away from the synthetic laminate 1. Outside of the projections 10 the strip 8 has a thickness of a value between the one of the band 2, to approximately twice as thick. The material for the strip 8 preferably is the same as the material of the laminate 1, so that a connection can be accomplished by melting together, for instance by ultrasonic welding. Alternatively another material can be used for the strip 8, but this should then be suitable to be able to form a connection with the laminate 1 in another way, for instance by gluing together.

According to the described method it is not necessary to accomplish a direct physical or chemical connection between the band 2 and laminate 1 in order to attach both parts to each other.

The FIGS. 5 and 6 are enlarged partial drawings of the band 2 and the strip 8 having the perforations 9 and the local projections 10, respectively. It will be clear that the projections alternatively can be arranged on the laminate 1. In this way a mechanical connection, in the case shown a clamping/enclosure, of the band 2 and the laminate 1 is obtained.

Instead of by providing the laminate or synthetic strip 8 with projections 10, the mechanical connection between band 2 and laminate 1 can also be accomplished by applying local quantities of glue (12) on laminate 1 or strip 8 such that after the laminate and the strip have been placed on the band the glue fills the perforations 9.

FIG. 7 shows an embodiment of the method and the booklet according to the invention, in which a portion at the thickness of band 2 and of the strip 8 has been milled away from the synthetic laminate 1. The strip 8 has a thickness of a value between the one of the band 2, until twice as thick. The material of the strip 8 and of the laminate can be the same or different, but both have to be suitable to adhere to the glue 12 in the perforations. The glue in the perforations has to have sufficient mechanical strength and tensile strength after drying and/or curing.

What is claimed is:

1. A method for manufacturing a booklet, wherein the booklet is provided with a number of sheets of paper and a cover material, each sheet having a front and a reverse side, each side comprising two pages, the method comprising the steps of:

connecting the sheets of paper to each other along a line between the pages;

attaching the cover material to an outside of the booklet;

making a fold in the sheets of paper to form a back of the booklet;

attaching a band in the booklet, which can be attached in the booklet in the same manner as in which the paper sheets are attached to each other; and mechanically attaching a plate to the band, the plate being at least partially made of synthetic material, and having a front and a reverse side, each side comprising one page, the mechanical attachment being accomplished by providing the band with perforations, providing a synthetic strip and providing the synthetic strip with local projections, placing the synthetic strip on the one side of the band, placing the plate on the other side, and connecting the local projections of the strip chemically or physically to the plate.

2. A method for manufacturing a booklet wherein the booklet is provided with a number of sheets of paper and a cover material, each sheet having a front and a reverse side, each side comprising two pages, the method comprising the steps of:

connecting the sheets of paper to each other along a line between the pages;

attaching the cover material to an outside of the booklet;

making a fold in the sheets of paper to form a back of the booklet;

attaching a band in the booklet, which can be attached in the booklet in the same manner as in which the paper sheets are attached to each other; and mechanically attaching a plate to the band, the plate being at least partially made of synthetic material, and having a front and a reverse side, each side comprising one page, the mechanical attachment being accomplished by providing the band with perforations, providing a synthetic strip, and providing the plate with local projections, placing the synthetic strip on one side of the band, placing the plate on the other side, and connecting the local projections of the plate chemically or physically to the strip.

3. The method according to claim 1 or 2, wherein the material of which the plate is made and the material of which the strip is made, contain the same raw material, and the plate and the strip are connected to each other by fusing them together.

4. The method according to claim 1 or 2, wherein the plate and the strip are connected by gluing them together.

5. A method for manufacturing a booklet, wherein the booklet is provided with a number of sheets of paper and a cover material, each sheet having a front and a reverse side, each side comprising two pages, the method comprising the steps of:

connecting the sheets of paper to each other along a line between the pages;

attaching the cover material to an outside of the booklet;

making a fold in the sheets of paper to form a back of the booklet;

attaching a band in the booklet, which can be attached in the booklet in the same manner as in which the paper sheets are attached to each other; and mechanically attaching a plate to the band, the plate being at least partially made of synthetic material, and having a front and a reverse side, each side comprising one page, the mechanical attachment being accomplished by providing the band with perforations, providing a synthetic strip, applying local quantities of glue on the synthetic strip, placing the synthetic strip on the one side of the band and placing the plate on the other side, wherein the glue fills at least partially the perforations in the band and connects the plate and the synthetic strip.

6. A method for manufacturing a booklet wherein the booklet is provided with a number of sheets of paper and a cover material, each sheet having a front and a reverse side, each side comprising two pages, the method comprising the steps of:

connecting the sheets of paper to each other along a line between the pages;

attaching the cover material to an outside of the booklet;

making a fold in the sheets of paper to form a back of the booklet;

attaching a band in the booklet, which can be attached in the booklet in the same manner as in which the paper sheets are attached to each other; and mechanically attaching a plate to the band, the plate being at least partially made of synthetic material, and having a front and a reverse side, each side comprising one page, the mechanical attachment being accomplished by providing the band with perforations, providing a synthetic strip, applying local quantities of glue on the plate, placing the synthetic strip on the one side of the band and placing the plate on the other side, wherein the glue fills at least partially the perforations in the strip and connects the plate and the synthetic strip.

7. A booklet provided with a number of sheets of paper and a cover material, each sheet having a front and a reverse side, and each side comprising two pages, the sheets of paper being connected to each other along a line between the pages, the cover material being attached to an outside of the booklet, a fold being made in the sheets of paper to form a back of the booklet, the booklet comprising:

a band, which is attached in the booklet in the same manner as in which the paper sheets are attached to each other, and is provided with perforations;

a plate, which is mechanically attached to the band, is at least partially made of synthetic material, and has a front and a reverse side, each side comprising one page; and a synthetic strip having local projections;

wherein the synthetic strip is placed on the one side of the band, and the plate is placed on the other side, and the local projections of the strip are chemically of physically connected to the plate, thereby mechanically attaching the plate to the band.

8. A booklet provided with a number of sheets of paper and a cover material, each sheet having a front and a reverse side, and each side comprising two pages, the sheets of paper being connected to each other along a line between the pages, the cover material being attached to an outside of the booklet, a fold being made in the sheets of paper to form a back of the booklet, the booklet comprising:

a band, which is attached in the booklet in the same manner as in which the paper sheets are attached to each other, and is provided with perforations;

a plate, which is mechanically attached to the band, is at least partially made of synthetic material, and has a front and a reverse, each side comprising one page, which plate is provided with local projections; and a synthetic strip, wherein the synthetic strip is, placed on the one side of the band, and the plate is placed on the other side, and the local projections of the plate are chemically or physically connected to the strip, thereby mechanically attaching the plate to the band.

9. The booklet according to claim 7 or 8, wherein the material of which the plate is made and the material of which the strip is made, contain the same raw material, and the plate and the strip are connected to each other by fusing them together.

10. The booklet according to claim 7 or 8, the plate and the strip are made from different raw materials, and are glued together.

11. A booklet provided with a number of sheets of paper and a cover material, each sheet having a front and a reverse side, and each side comprising two pages, the sheets of paper being connected to each other along a line between the pages, the cover material being attached to an outside of the booklet, a fold being made in the sheets of paper to form a back of the booklet, the booklet further comprising:

a band, which is attached in the booklet in the same manner as in which the paper sheets are attached to each other, which band is provided with perforations;

a plate, which is mechanically attached to the band, the plate is at least partially made of synthetic material, and having a front and a reverse side, each side comprising one page; and a synthetic strip, wherein local quantities of glue are applied on the synthetic strip, the synthetic strip is placed on the one side of the band and the plate is placed on the other side, the glue at least partially fills the perforations in the band and connects the plate and the synthetic strip, thereby mechanically attaching the plate to the band.

12. A booklet provided with a number of sheets of paper and a cover material, each sheet having a front and a reverse side, and each side comprising two pages, the sheets of paper being connected to each other along a line between the pages, the cover material being attached to an outside of the booklet, a fold being made in the sheets of paper to form back of the booklet, wherein the booklet further comprises:

a band, which is attached in the booklet in the same manner as in which the paper sheets are attached to each other, the band being provided with perforations, a plate, which plate is mechanically attached to the band, is at least partially made of synthetic material, and has a front and a reverse, each side comprising one page, and a synthetic strip, wherein local quantities of glue are applied on the plate, the synthetic strip is placed on the one side of the band and the plate is placed on the other side, and the glue at least partially fills the perforations in the band and connects the plate and the synthetic strip, thereby mechanically attaching the plate to the band.

* * * * *